US006543169B2

(12) United States Patent
Bero

(10) Patent No.: US 6,543,169 B2
(45) **Date of Patent: *Apr. 8, 2003**

(54) SEMI-AUTOMATIC FIRING AND DISCONNECTING DEVICE FOR A NON-HAMMER FIRED MACHINE GUN

(76) Inventor: Timothy S. Bero, P.O. Box 311, Vernonia, OR (US) 97064

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/140,627

(22) Filed: Aug. 25, 1998

(65) Prior Publication Data

US 2003/0037666 A1 Feb. 27, 2003

(51) Int. Cl.[7] ..... F41A 19/32
(52) U.S. Cl. ..... 42/69.02; 89/27.11; 89/145
(58) Field of Search ..... 89/144, 145, 27.11; 42/69.02, 69.03

(56) References Cited

U.S. PATENT DOCUMENTS 730,870 A * 6/1903 Browning ..... 89/145
2,922,241 A * 1/1960 Brunelle ..... 42/69.03
2,992,597 A * 7/1961 Lizza ..... 89/145
3,670,442 A * 6/1972 Kennedy et al. ..... 42/69.02
3,696,543 A * 10/1972 Kennedy et al. ..... 42/67
4,361,072 A * 11/1982 Karlsen ..... 89/154
4,641,449 A * 2/1987 Kapland et al. ..... 42/65
4,658,702 A * 4/1987 Tatro ..... 89/139
4,693,027 A * 9/1987 Wolff, Sr. et al. ..... 42/59
5,517,897 A * 5/1996 Perrine ..... 89/144

FOREIGN PATENT DOCUMENTS

AU 153175 * 3/1951 ..... 89/144

* cited by examiner

*Primary Examiner*—Stephen M. Johnson
(74) *Attorney, Agent, or Firm*—Birdwell, Janke & Durando, PLC

(57) ABSTRACT

A semi-automatic firing and disconnecting device for a non-hammer fired machine. A first trigger member coupled to the weapon's firing pin and a second trigger member adapted for engagement by a user of the weapon move relative to one another from a first position, in which the trigger members are operably connected to one another, to a second position, in which the trigger members are not operably connected to one another, and back to the first position as a result of firing the weapon. The configuration of the second trigger member, upon the trigger members' returning to the first position from the second position, is altered so that the trigger members are not enabled to fire unless and until the user releases and reengages the second trigger member.

17 Claims, 6 Drawing Sheets

SEMI-AUTOMATIC FIRING AND DISCONNECTING DEVICE FOR A NON-HAMMER FIRED MACHINE GUN

BACKGROUND OF THE INVENTION

The present invention relates to a semi-automatic firing and disconnecting device for a non-hammer fired machine gun. More particularly, the invention relates to converting the same to semi-automatic, rapid fire use.

There is a strong interest among gun collectors to own and use fully automatic weapons, particularly vintage weapons such as those employed during the second world war. The desirability of these weapons can go beyond filling a need for fully automatic operation. Unfortunately, some criminal misuse of automatic weapons has induced the federal government to severely restrict their ownership and use. While there are an increasing number of government regulations concerning the possession of semi-automatic weapons, these requirements so far have been much more easily and inexpensively met.

Accordingly, there is a need for a semi-automatic firing and disconnecting device for a non-hammer fired machine gun that provides for converting the same to semi-automatic, rapid fire use, avoiding the registration and certification required for fully automatic weapons while retaining much of the enjoyment thereof.

SUMMARY OF THE INVENTION

The semi-automatic firing and disconnecting device for a non-hammer fired machine gun of the present invention solves the aforementioned problem and meets the aforementioned needs by providing a first trigger member and a second trigger member that may be provided originally in the weapon, or that may represent modifications of similar components existing in the weapon. In the existing, automatic weapon, the second trigger member is adapted to receive a force applied by a user for firing the weapon, and to transmit the force to the first trigger member which releases the weapon's firing pin. The first trigger member and the second trigger member are further adapted for cyclic movement relative to one another from a first position, in which the trigger members are operably connected to one another, to a second position, in which the trigger members are not operably connected to one another, and back to the first position as a result of firing the weapon. During a cycle of movement between the first and second positions, the first and second trigger members operate to fire the weapon and to reset the weapon for firing again, the trigger members upon returning to the first position from the second position being automatically enabled to repeat fire so long as the user continues to apply force to the second trigger member.

According to the present invention, however, the configuration of the second trigger member, upon the trigger members' returning to the first position from the second position, is automatically altered so that the trigger members are not enabled to fire unless and until the user releases and reengages the second trigger member.

Also according to the invention, the first and second trigger members, as well as other parts of the weapon, may be keyed to mating, keying parts so that parts that have been modified or employed for semi-automatic operation cannot be replaced with original or other parts permitting fully automatic operation.

Therefore, it is a principal object of the present invention to provide a novel and improved semi-automatic firing and disconnecting device for a non-hammer fired machine gun.

It is another object of the present invention to provide such a firing and disconnecting device that provides for converting the non-hammer fired machine gun to semi-automatic, rapid fire use.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
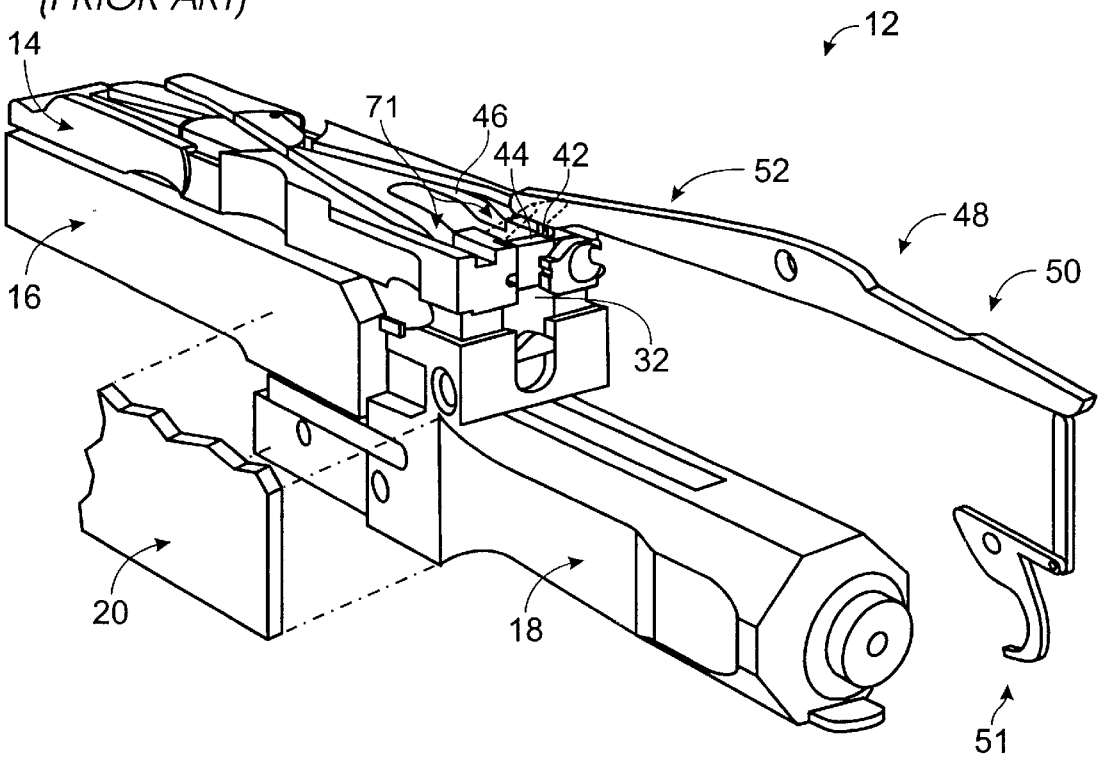
Fig. 1 (PRIOR ART)
FIG. 1 is a partially exploded pictorial view of a prior art non-hammer fired machine gun.

FIG. 1 shows a prior art non-hammer fired machine gun 12. The gun 12 generally has a bolt 14, a barrel extension 16 and a buffer assembly 18. These components mount as a module into a housing 20. A barrel (not shown) is screwed into the barrel extension for guiding the path of ammunition (also not shown) that is fed into the side of the barrel extension as the weapon fires. Further discussion of the manner in which the ammunition is introduced into the gun, is fired and is discharged from the gun is omitted as not particularly pertinent to the present invention.

Figure 2:
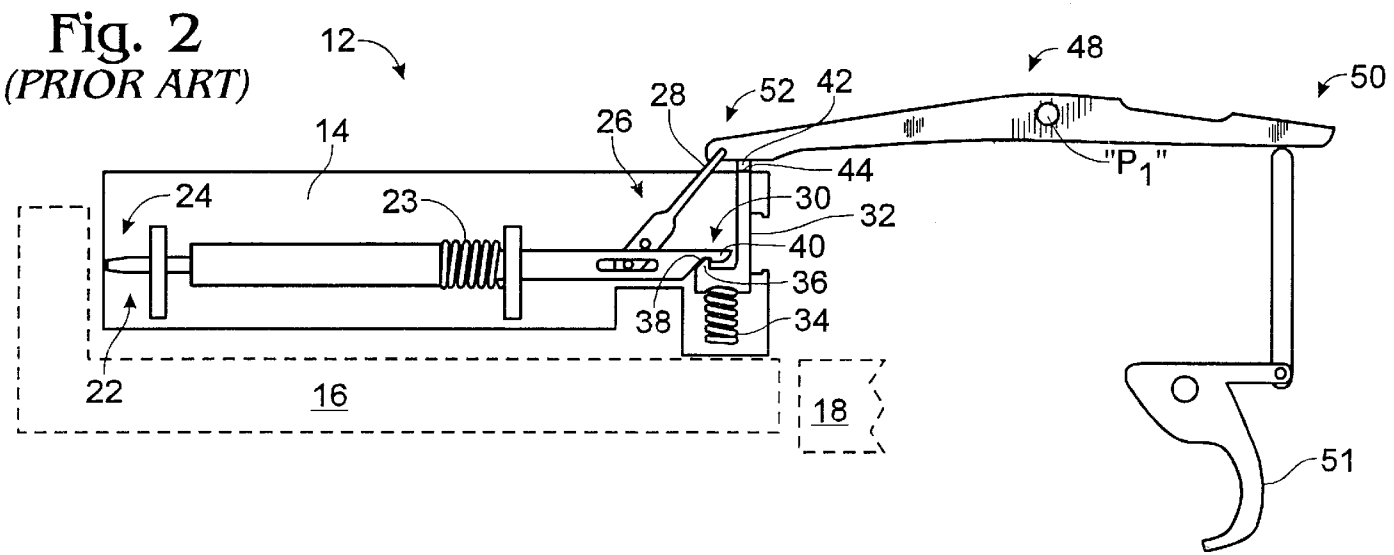
Fig. 2 (PRIOR ART)
FIG. 2 is a schematic of the prior art machine gun of FIG. 1, shown in a ready-to-fire configuration.

Referring to FIG. 2, the bolt 14 carries a triggering mechanism including an elongate firing pin 22, the bolt being adapted to slidingly recoil with respect to the barrel extension 16 in response to firing, from a ready-to-fire position, to a recoiling position and back to the ready-to-fire position under power of a compression spring (not shown) biasing the bolt forwardly.

In the non-hammer fired machine gun, the firing pin 22 is spring-biased forwardly by a spring biasing means 23, toward the barrel, so that a distal end 24 thereof extends sufficiently into the barrel to impact the bullet and fire it. The firing pin is set by pulling it backwardly, toward the buffer assembly 18. This is accomplished with a cocking lever 26 that is pivotally mounted to the bolt 14. For purposes of illustrating the operation of the machine gun 12, assume the firing pin 22 is in its fully biased position, corresponding to the gun having been fired. An upwardly extending portion 28 of the cocking lever is then in a backward-most facing position.

Forcing the upwardly extending portion 28 of the cocking lever forwardly, against the bias of the firing pin, pulls a proximal end 30 of the firing pin backwardly, toward a sear plate 32 also disposed in the bolt 14. The sear plate is slidably retained to the bolt for movement upwardly and downwardly, and is spring biased upwardly with a coil spring 34.

The sear plate has a forwardly protruding portion 36 having an upwardly extending lip 38. The proximal end 30 of the firing pin has a corresponding, downwardly extending lip 40. The upwardly extending lip 38 of the sear plate is adapted to slide slightly under the downwardly extending lip 40 of the firing pin as the firing pin is pulled toward the sear plate, against the spring biasing of the coil spring 34. However, once the lip 40 has cleared the lip 38, the spring 34 returns the sear plate to its fully biased, upwardly extending position, the lips being adapted to lock together to capture the firing pin in a cocked position for firing, as shown in FIG. 2. The cocking lever 26 is further adapted so that the upwardly extending portion 28 thereof must be returned to its backward-most facing position to release control of the firing pin to the sear plate so that the gun is ready to fire.

The sear plate 32 has an upwardly extending tab 42 at a top surface 44 thereof. The tab extends above a top surface 46 of the bolt 14 in the fully biased position of the sear plate, such as when the gun is in the aforementioned ready-to-fire position.

An elongate trigger bar 48 is pivotally connected to the housing 20 at the pivot point "P1 ". A proximal end 50 of the trigger bar is connected to a trigger 51 adapted for manipulation by the user of the gun. The trigger 51 is shown in FIGS. 1–5, 8, 9, 12 and 13 in schematized form as being equivalent to the familiar trigger of a pistol or rifle, the actual trigger of a machine gun being operated with the thumb, this difference not being pertinent to the invention. The gun 12 may also be "dry fired" as well, by manipulating the trigger bar directly.

Figure 3:
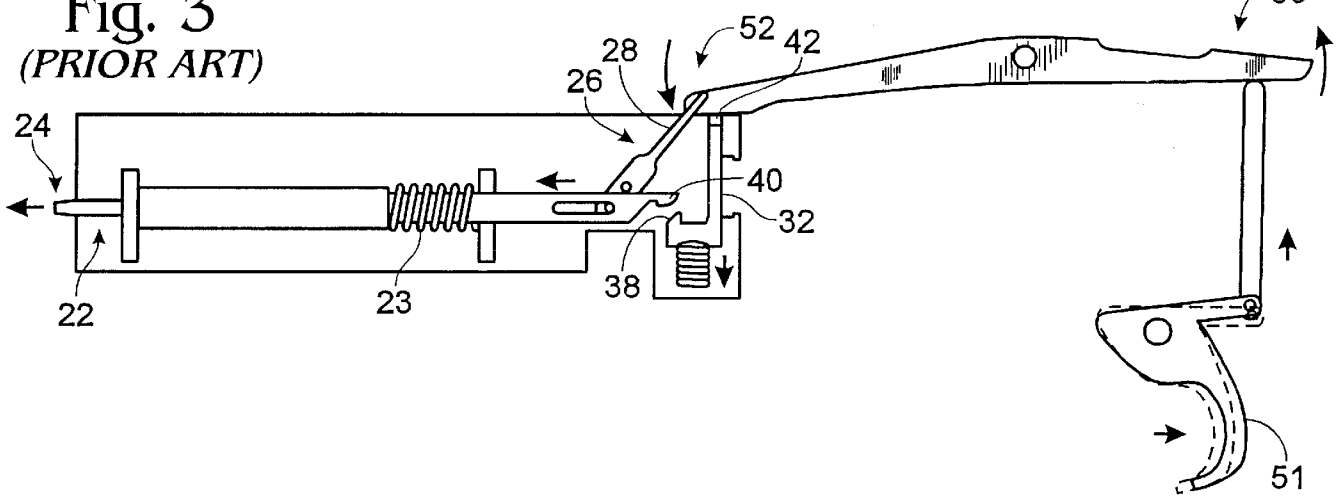
Fig. 3 (PRIOR ART)
FIG. 3 is a schematic of the prior art machine gun of FIG. 1, shown as firing in response to movement of a trigger.

As shown in FIG. 3, when the trigger 51 is pulled by the user's finger, the proximal end 50 of the trigger bar is pushed upwardly and a distal end 52 of the trigger bar is pushed downwardly. In the ready-to-fire, or forward-most position of the bolt of FIG. 2, the distal end 52 of the trigger bar is adapted to press downwardly on the tab 42 of the sear plate 32. This disengages the lip 38 of the sear plate from the lip 40 of the firing pin, as shown in FIG. 3, releasing the firing pin 22 so that it is carried forward by its spring biasing means 23, the distal end 24 of the firing pin 22 impacting and detonating the ammunition.

Figure 4:
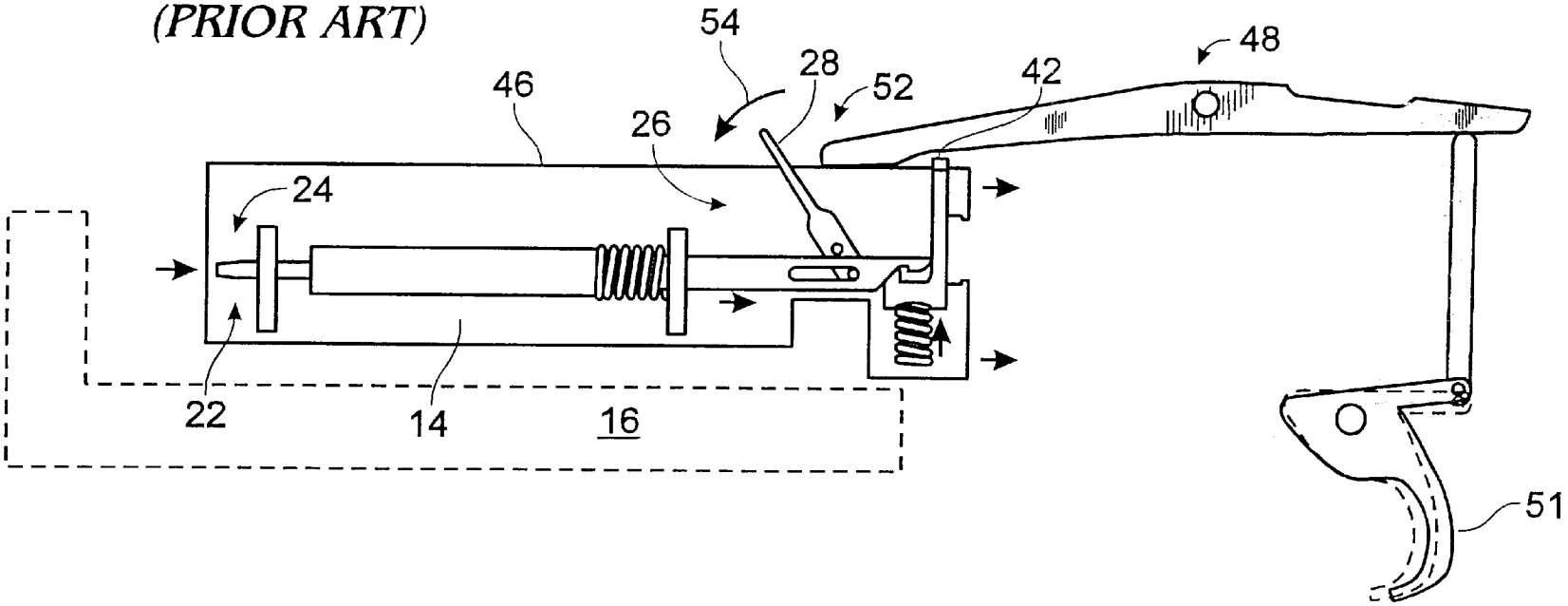
Fig. 4 (PRIOR ART)
FIG. 4 is a schematic of the prior art machine gun of FIG. 1, shown as recoiling in response to the firing of FIG. 3.

Turning to FIG. 4, the bolt 14 is slidably mounted to the barrel extension 16 to permit backward travel of the bolt in the direction of the arrows, in response to the force exerted by the ammunition. As the bolt travels backwardly, the distal end 52 of the trigger bar 48 loses contact with the tab 42.

The housing 20 includes a projection indicated schematically as 54, adapted to trip the upwardly extending portion 28 of the cocking lever 26 from the aforementioned backward-most facing position as the lever passes thereby during recoil of the bolt 14, for re-setting the firing pin 22 as explained above. Accordingly, resetting of the firing pin is automatic. Moreover, so long as the trigger 51 is held in its firing or "on" position by the user, the distal end 52 of the trigger bar 48 remains in position to press the tab 42 of the sear plate downwardly as soon as the bolt returns to its ready-to-fire position, to automatically fire the weapon. Repetitive resetting and firing of the weapon continues until the trigger is released, or otherwise moved from its "on" position to an "off" position.

Figure 5:
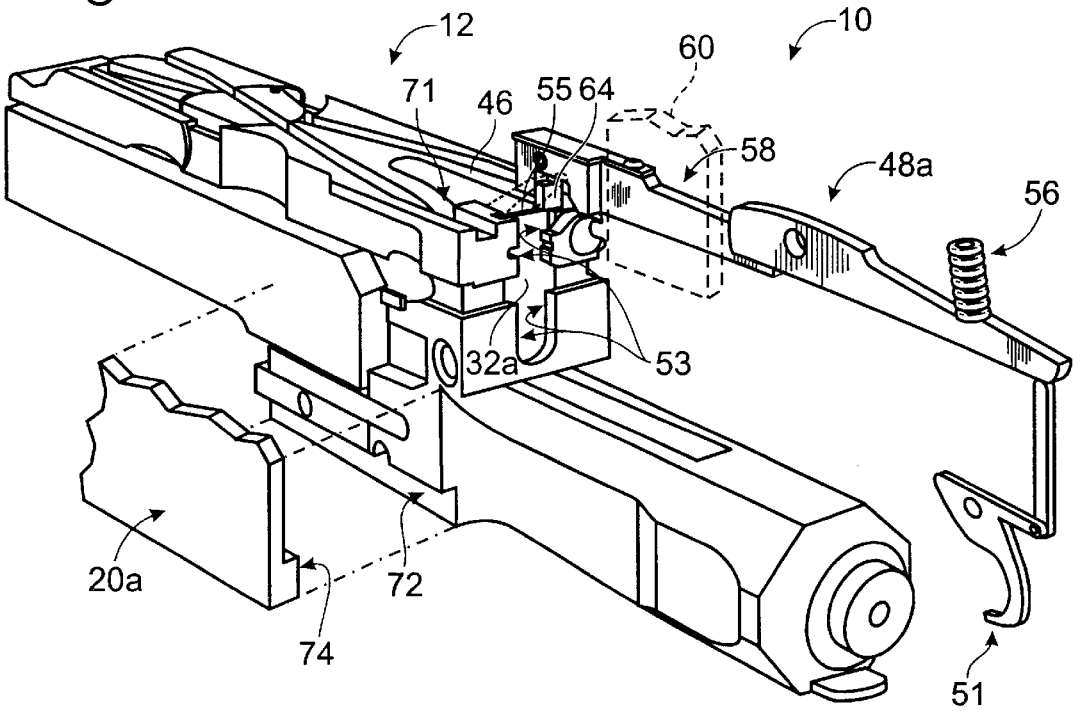
FIG. 5 is a partially exploded pictorial view of a semi-automatic firing and disconnecting device according to the present invention, employed with the machine gun of FIG. 1.

Turning now to FIG. 5, a preferred semi-automatic firing and disconnecting device 10 according to the present invention is particularly adapted for use with the just-described non-hammer fired machine gun 12 is shown. An outstanding feature of the invention is that it permits a fully automatic weapon to be operated as a semi-automatic weapon, and to be regulated as such. In the preferred embodiment of the invention, the sear plate 32 and the trigger bar 48 are replaced with corresponding parts 32*a* and 48*a* as described below to provide this feature. However, while illustrated as modifying an existing weapon 12, the invention may be equally well employed in a weapon as it is initially fabricated.

The sear plate 32*a* is formed similarly to the sear plate 32, except that the tab 42 is omitted, leaving a top surface 55 of the sear plate that is substantially flush with the top surface 46 of the bolt 14 when the sear plate 32*a* is in its fully biased, upward position. In addition, preferably, the sear plate 32*a* is widened and the bolt is modified by widening grooves 53 into which the original sear plate 32 is slidably retained. This latter modification is for the purpose of preventing use of the original sear plate, such as in an attempt to defeat the conversion to semi-automatic firing.

Figure 6:
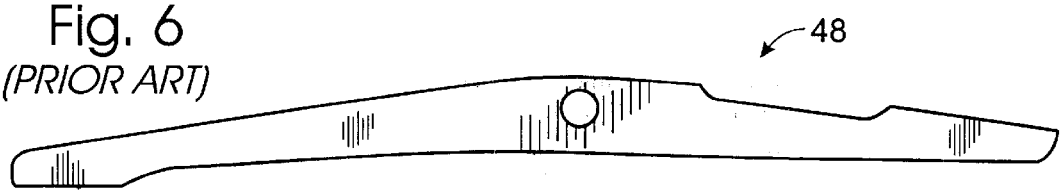
Fig. 6 (PRIOR ART)
FIG. 6 is a side elevation of a trigger bar of the machine gun of FIG. 1.
Figure 7:
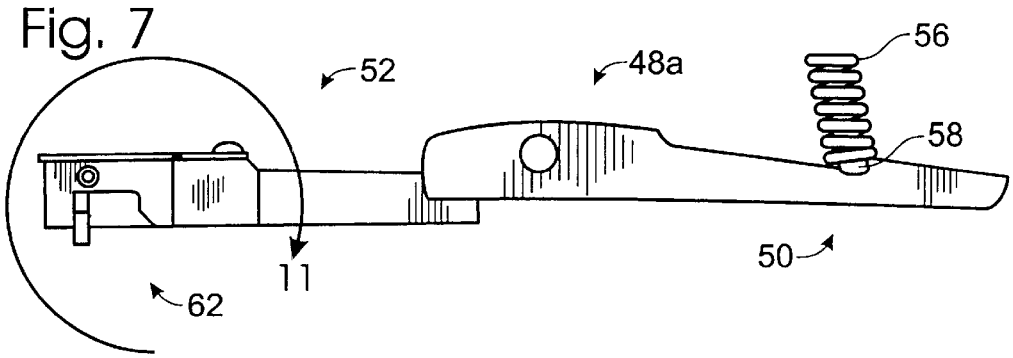
FIG. 7 is a side elevation of a trigger bar according to the present invention, for use in the semi-automatic firing and disconnecting device of FIG. 5.
Figure 8:
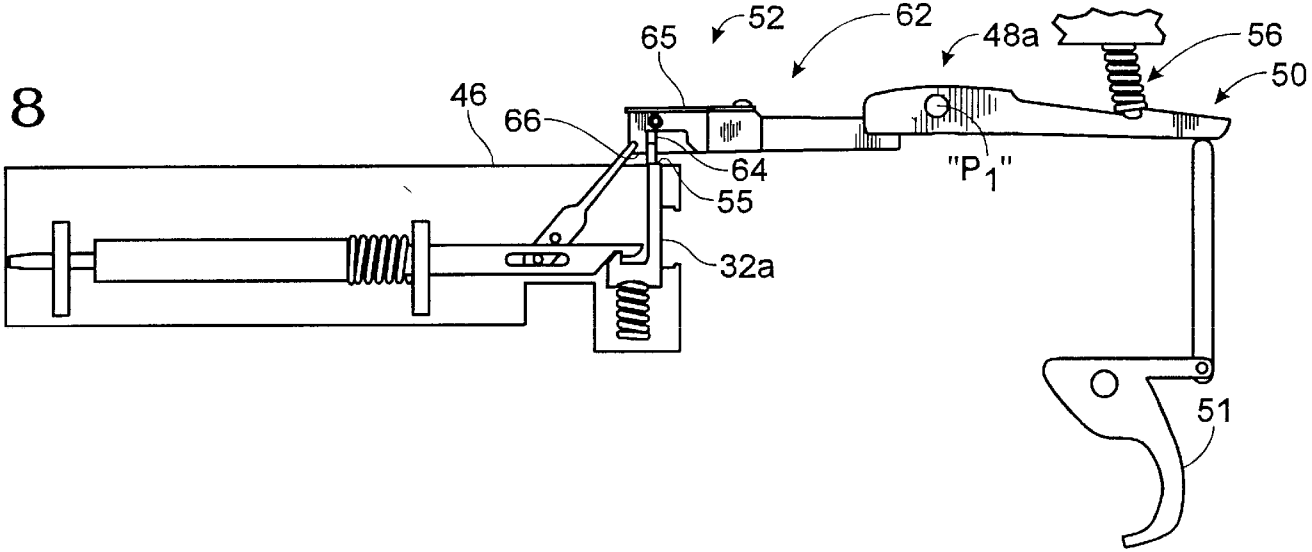
FIG. 8 is a schematic of the semi-automatic firing and disconnecting device of FIG. 5, shown in a ready-to-fire configuration.
Figure 9:
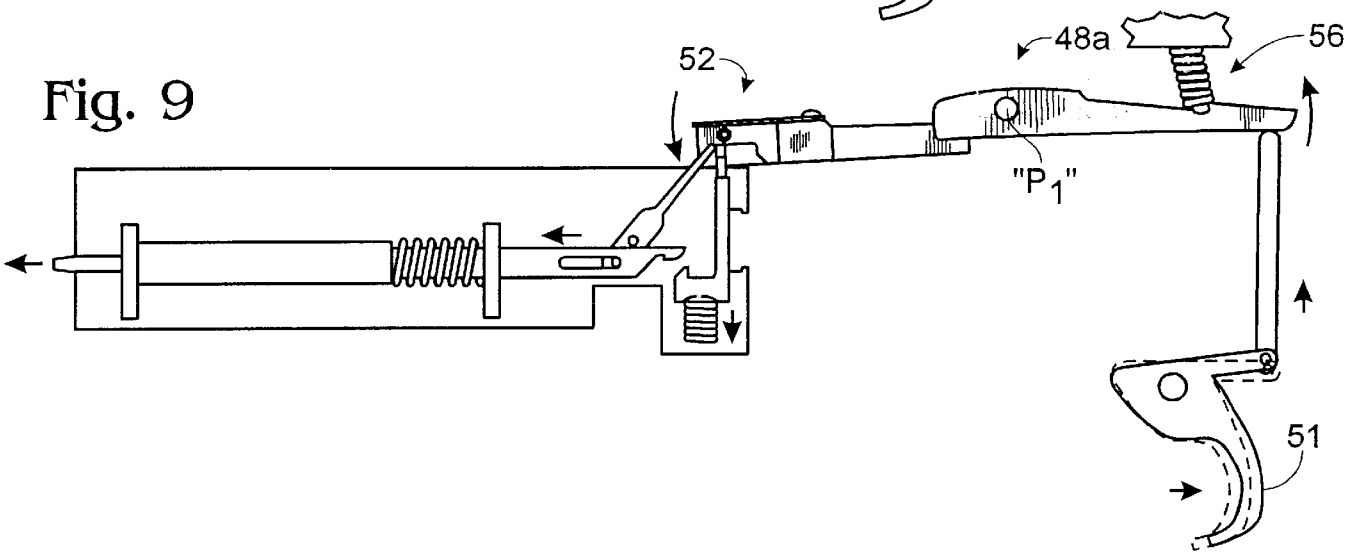
FIG. 9 is a schematic of the semi-automatic firing and disconnecting device of FIG. 5, shown as firing in response to movement of a trigger.

As best seen by comparing FIGS. 6 and 7, the trigger bar 48*a* may be formed from portions of the trigger bar 48. As shown in FIG. 7, the trigger bar 48*a* includes a coil spring 56 and a mount 58 attached to the trigger bar 48*a* for disposing the spring 56 upwardly proximate the proximal end 50, spring biasing the trigger bar in a non-firing position, corresponding to the "off" position of the trigger 51. Accordingly, as shown in FIG. 8, the coil spring 56, acting through the pivot point "P1" of the trigger bar, lowers the distal end 52 of the trigger bar against the sear plate when the trigger is pulled or moved to its "on" position, as will be explained in more detail below.

Figure 10:
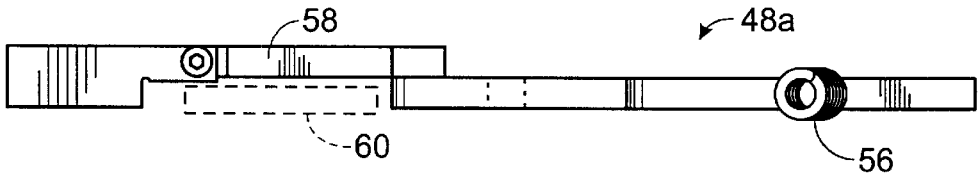
FIG. 10 is a top view of the trigger bar of FIG. 7.

Referring to FIGS. 5 and 10, the trigger bar 48*a* also includes an offset portion 58 that forms the trigger bar around a trigger bar block 60 extending downwardly adjacent the offset portion. The offset portion 58 keys the trigger bar 48*a* to the trigger bar block 60 so that the original trigger bar 48 may no longer be used. This modification is also for preventing defeat of the conversion to semi-automatic firing.

Figure 11:
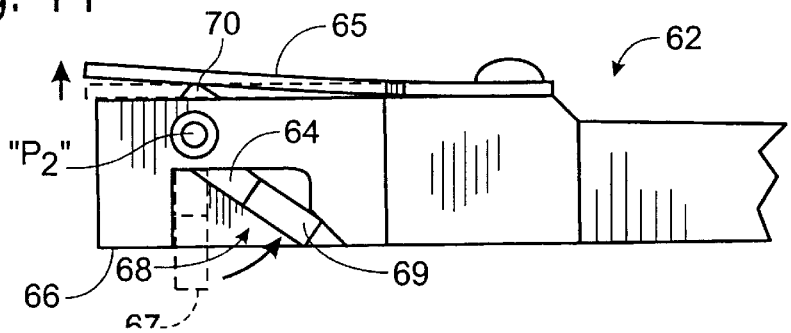
FIG. 11 is a detail of the trigger bar of FIG. 7, indicated by the arc 11 thereof, showing an extendable lever of a trigger gate mechanism according to the present invention moving from an extended position to a retracted position.

Referring to FIGS. 7 and 11, the distal end 52 of the trigger bar 48 is modified in the trigger bar 48*a* so that it includes a trigger gate mechanism 62 adapted to ride along the top surface 46 of the bolt 14. The trigger gate mechanism includes an extendable lever 64, spring biased with a leaf spring 65. In a preferred embodiment of the invention, the lever 64 is adapted to pivot, from a spring biased, extended position 67 in which it extends downwardly beneath a relatively large bottom surface 66 of the mechanism, to a retracted position 69 wherein the lever retracts into the mechanism sufficiently that the lever is flush with the bottom surface 66.

As seen in FIG. 11, the lever 64 is pivotally mounted in the trigger gate mechanism 62 in a recess 68 at a pivot point "P2." When in its extended position 67, the lever is oriented so that a force applied upwardly thereto passes through the pivot point and fails to pivot the lever. Accordingly, the lever in its extended position may support large upwardly directed forces. However, forces applied in the direction of motion of the bolt 14 will readily pivot the lever up into the recess 68 in the direction of the arrow, where it is received so as not to extend beyond the bottom surface 66. The lever 64 includes a cam 70 that rides against the leaf spring 65 for biasing the lever against the retracted position.

In the preferred embodiment, the pivot point "P2" is disposed in the recess 68 so that the lever is permitted to pivot backwardly but not forwardly. However, this is not essential to practice of the invention, and the lever may be permitted to pivot in either or both directions without departing from the principles thereof.

Referring back to FIG. 8, in the aforedescribed forward-most, ready-to-fire position of the bolt 14, the lever 64 in its biased, extended position rests on the top surface 55 of the sear plate 32*a*. Then, forcing the distal end 52 of the trigger bar 48 downwardly, by moving the trigger 51, permits the lever 64 to press the sear plate downwardly. The length of the lever 64 is adjusted so that, when the bottom surface 66 reaches the top surface 46, the sear plate has been moved downwardly sufficiently to disengage the lips 38 and 40 and permit the weapon to fire.

Figure 12:
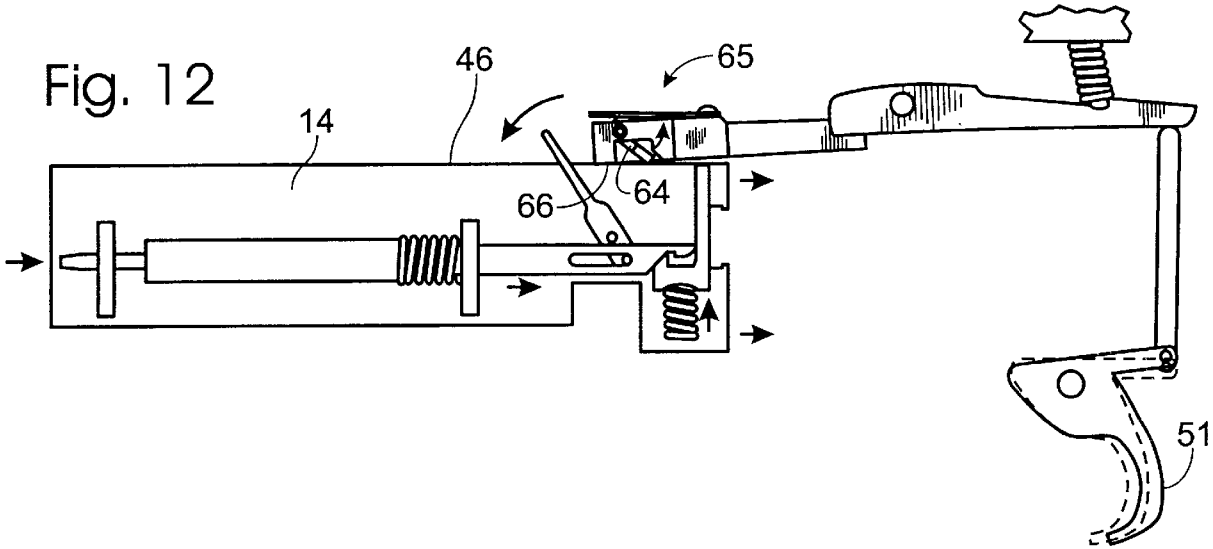
FIG. 12 is a schematic of the semi-automatic firing and disconnecting device of FIG. 5, shown as recoiling, in response to the firing of FIG. 9.

Turning now to FIG. 12, the bolt 14 recoils backwardly. The lever 64 is then pulled by the recoiling bolt backwardly into its retracted position. Thereafter, the bottom surface 66 rides on the top surface 46 of the bolt rather than the lever 64.

The amount of bias provided the lever 64 by the cam 70 and leaf spring 65 is adjusted so that it is insufficient to force the lever into its extended position against the force applied at the trigger of the gun so long as the user maintains the trigger 51 "on". Therefore, referring to FIG. 13, when the bolt 14 returns to its ready-to-fire position, the lever 64 remains retracted so that the bottom surface 66 remains in contact with the top surface 46.

However, in the retracted position of the lever, the bottom surface 66 is all that is available to contact the top surface 55 of the sear plate 32*a*. As has been described, the top surface 55 of the sear plate is substantially flush with the top surface 46 when the sear plate is fully biased upwardly. Accordingly, the bottom surface 66 cannot select the top surface 55 of the sear plate to depress it and fire the weapon again.

Figure 13:
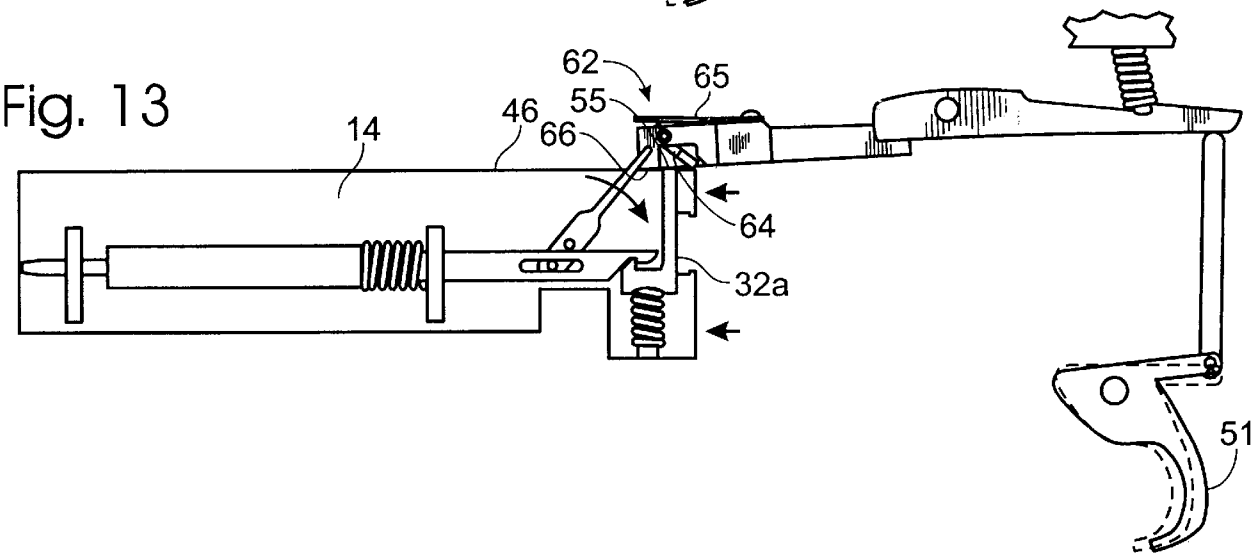
FIG. 13 is a schematic of the semi-automatic firing and disconnecting device of FIG. 5, shown as returned to the ready-to-fire configuration of FIG. 8; however, without the trigger having been released.

Referring to FIGS. 13 and 8 in sequence, this condition remains until the distal end 52 of the trigger bar 48*a* is lifted from the top surface 46 of the bolt, by releasing the trigger 51 and enabling the spring 56 to pivot the trigger bar. As the distal end 52 of the trigger gate mechanism 62 is moved upwardly, the bottom surface 66 separates from the top surface 46 of the bolt, allowing the leaf spring 65 to pivot the lever 64 back into its extended position so that it is readied for another firing. Accordingly, cooperation of the sear plate 32*a* and the trigger gate mechanism 62 effectively converts the formerly automatic weapon to semi-automatic operation. This provides for "rapid fire," because the lever will return to its extended position any time during the aforementioned cycle that the trigger gate mechanism is lifted by the spring 56, so that, so long as this is accomplished sometime during a firing cycle, there is no loss of time.

Referring back to FIG. 5, the top surface 46 of the bolt 14 is modified as necessary by filling in grooves or other depressions thereon so that the lever 64 may ride continuously on the top surface 46 over the course of travel of the bolt 14, preventing the lever from pivoting to its extended position during this course while the trigger is "on." In a typical modification for the bolt of a 0.50 Caliber M2 weapon, as can best be seen by comparing FIGS. 1 and 5, the right side one of two notches 71 proximate the cocking lever 26 (FIG. 2) is built up so as to be at the same level as the top surface 46 by welding in additional metal. These notches are typically employed for holding the bolt in its backward-most position in a position for maintaining the weapon that prevents firing thereof.

The housing 20 is also preferably replaced with a housing 20*a* having a relief surface that is machined to key with a complementary relief surface machined into the gun 12. This is to further defeat attempts to replace the modified parts with their automatic counterparts. To be effective for this purpose, the surfaces may take any form, so long as they are keyed together and differ from the stock parts. For example, grooves or planed surfaces may be machined into the barrel extension, bolt and buffer assembly and the housing may have corresponding raised portions that remain from milling aluminum sheet. As a particular example for purposes of illustration, a keyed recess 72 may be machined into the barrel extension and buffer assembly, while a raised, keying portion 74 may be provided in the housing 20*a*. While in FIG. 5, this modification is shown on the left side of the gun for purposes of illustration, it is preferable that this modification be made on the right side of the gun on account of federal regulations.

It is to be recognized that, while a specific semi-automatic firing and disconnecting device for a machine gun has been shown and described as preferred, other configurations could be utilized, in addition to configurations already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A semi-automatic firing and disconnecting device for a weapon for use with ammunition, the weapon having a first trigger member and a second trigger member, the second trigger member being adapted to receive a firing force from a user for firing the weapon and thereby detonating the ammunition, the first and second trigger members being adapted for cyclic movement relative to one another from a first position, in which the trigger members are operably connected to one another to a second position, in which the trigger members are not operably connected to one another, the semi-automatic firing and disconnecting device comprising a third trigger member adapted to replace said second trigger member, said third trigger member including a trigger gate mechanism, said trigger gate mechanism including an extendable member, said extendable member being adapted to:

(a) transmit the firing force to the first trigger member in an extended configuration so long as the first and third trigger members are in the first position, (b) be incapable of transmitting the firing force to the first trigger member in a retracted configuration, (c) move from said extended configuration to said retracted configuration in response to the recoil of the first trigger member obtained as a result of firing the weapon, and (d) remain in said retracted configuration until the firing force is substantially reduced.

2. The semi-automatic firing and disconnecting device of claim 1, wherein said trigger gate mechanism is adapted so that, in said retracted configuration and when the firing force is substantially reduced, said trigger gate mechanism returns to said extended configuration.

3. The semi-automatic firing and disconnecting device of claim 2, wherein said extendable member comprises a lever that is spring biased toward said extended configuration.

4. The semi-automatic firing and disconnecting device of claim 1, wherein said extendable member includes a lever pivotally connected thereto and a leaf spring for biasing said lever.

5. The semi-automatic firing and disconnecting device of claim 4, wherein said trigger gate mechanism includes a recess for receiving said lever in said retracted configuration.

6. A semi-automatic firing and disconnecting device for a weapon for use with ammunition, the weapon having a first trigger member, a second trigger member and a bolt adapted for backward travel in the weapon in response to the force exerted by detonating the ammunition, the second trigger member being adapted to receive a firing force from a user for firing the weapon and thereby detonating the ammunition and the first trigger member being carried by the bolt, the first and second trigger members being adapted for cyclic movement relative to one another from a first position, in which the trigger members are operably connected to one another, to a second position, in which the trigger members are not operably connected to one another, the semi-automatic firing and disconnecting device comprising a third trigger member adapted to replace said second trigger member, said third trigger member including a trigger gate mechanism, said trigger gate mechanism being further adapted to transmit the firing force to the first trigger member in a first configuration so long as the first and third trigger members are in the first position and to be incapable of transmitting the firing force to the first trigger member in a second configuration, wherein said trigger gate mechanism is adapted to be placed in said second configuration from said first configuration by movement of the bolt.

7. The semi-automatic firing and disconnecting device of claim 6, wherein said trigger gate mechanism includes an extendable member, said extendable member being extended in said first configuration and retracted in said second configuration against a spring bias.

8. The semi-automatic firing and disconnecting device of claim 7, wherein said trigger gate mechanism is adapted to remain in said second configuration until the firing force is substantially reduced.

9. The semi-automatic firing and disconnecting device of claim 8, wherein said trigger gate mechanism is adapted to adopt said first configuration as a result of substantially reducing the firing force.

10. The semi-automatic firing and disconnecting device of claim 7, wherein said bias is provided by a leaf spring.

11. The semi-automatic firing and disconnecting device of claim 10, wherein said trigger gate mechanism includes a recess for receiving said extendable member in said second configuration.

12. The semi-automatic firing and disconnecting device of claim 6, wherein said trigger gate mechanism includes a lever pivotally connected thereto and a leaf spring for biasing said lever.

13. A weapon for use with ammunition, the weapon comprising a first trigger member and a second trigger member, said second trigger member being adapted to receive a firing force from a user for firing the weapon and thereby detonating the ammunition, said first and second trigger members being adapted for cyclic movement relative to one another from a first position, in which said trigger members are operably connected to one another, to a second position, in which said trigger members are not operably connected to one another, said second trigger member including a trigger gate mechanism, said trigger gate mechanism including an extendable member, said extendable member being adapted to:

(a) transmit the firing force to the first trigger member in an extended configuration so long as the first and second trigger members are in the first position, (b) be incapable of transmitting the firing force to the first trigger member in a retracted configuration, (c) move from said extended configuration to said retracted configuration in response to the recoil of the first trigger member obtained as a result of firing the weapon, and (d) remain in said retracted configuration until the firing force is substantially reduced.

14. The weapon of claim 13, wherein said extendable member comprises a lever pivotally connected to said trigger gate mechanism and wherein said trigger gate mechanism includes a leaf spring for biasing said lever toward said extended configuration.

15. A weapon for use with ammunition, the weapon comprising a first trigger member, a second trigger member and a bolt adapted for backward travel in the weapon in response to the force exerted by detonating the ammunition, said second trigger member being adapted to receive a firing force from a user for firing the weapon and thereby detonating the ammunition and said first trigger member being carried by said bolt, said first and second trigger members being adapted for cyclic movement relative to one another from a first position, in which said trigger members are operably connected to one another, to a second position, in which said trigger members are not operably connected to one another, said second trigger member including a trigger gate mechanism, said trigger gate mechanism being further adapted to transmit the firing force to said first trigger member in a first configuration so long as said first and second trigger members are in the first position and to be incapable of transmitting the firing force to said first trigger member in a second configuration, wherein said trigger gate mechanism is adapted to be placed in said second configuration from said first configuration by movement of said bolt.

16. The weapon of claim 15, wherein said trigger gate mechanism includes a lever pivotally connected thereto and a leaf spring for biasing said lever toward said first configuration.

17. The weapon of claim 15, wherein said trigger gate mechanism includes an extendable member, said extendable member being extended in said first configuration and retracted in said second configuration against a spring bias.

* * * * *